United States Patent [19]

Müller

[11] Patent Number: 4,479,330

[45] Date of Patent: Oct. 30, 1984

[54] MECHANICALLY CONTROLLED SEALING RAIL FOR DOOR LEAF

[76] Inventor: Luis C. Müller, Muntaner, 184-2°, Barcelona-36, Spain

[21] Appl. No.: 539,554

[22] Filed: Oct. 6, 1983

[51] Int. Cl.[3] ..... E06B 7/20

[52] U.S. Cl. ..... 49/303; 49/321

[58] Field of Search ..... 49/310, 312, 311, 303, 49/306, 307, 308, 309, 321, 316

[56] References Cited

U.S. PATENT DOCUMENTS

| | | | |
|---|---|---|---|
| 799,475 | 9/1905 | Learned | 49/307 |
| 2,344,278 | 3/1944 | Balousek | 49/307 |
| 3,703,788 | 11/1972 | Rivers | 49/307 |

FOREIGN PATENT DOCUMENTS

| | | | |
|---|---|---|---|
| 219583 | 8/1958 | Australia | 49/307 |

*Primary Examiner*—Philip C. Kannan

*Attorney, Agent, or Firm*—Brady, O'Boyle & Gates

[57] ABSTRACT

A pair of V-shaped springs pointing toward each other have hook shaped ends connected into the ends of a sealing rail positioned across the bottom edge of a door leaf. The upper end of one spring is anchored to the door and the upper end of the other spring is guidingly connected to protrude beyond the edge of the door. An outwardly biased lever actuator connected on the edge of the door contacts the door frame when the door is closed and urges the protruding spring end inwardly and moves the sealing rail through the pair of springs laterally and downwardly into sealing engagement with the floor to seal the air gap beneath the door.

9 Claims, 8 Drawing Figures

FIG. 1
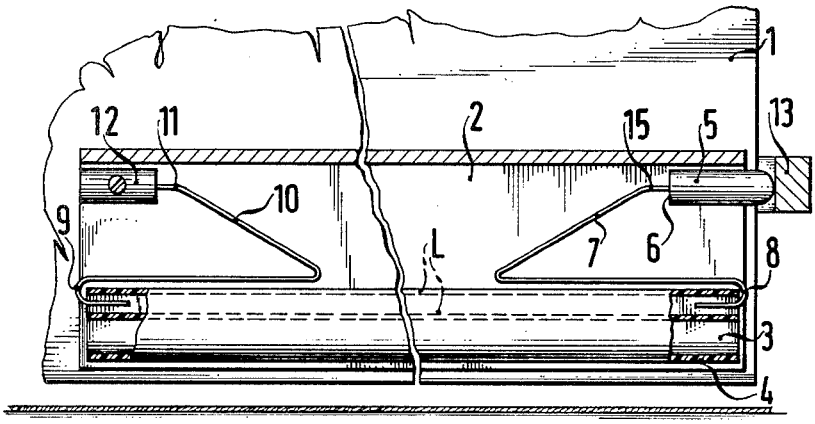
FIG. 2
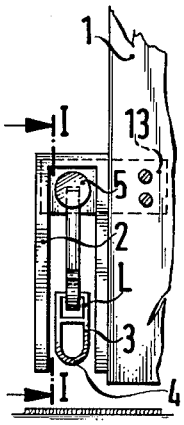
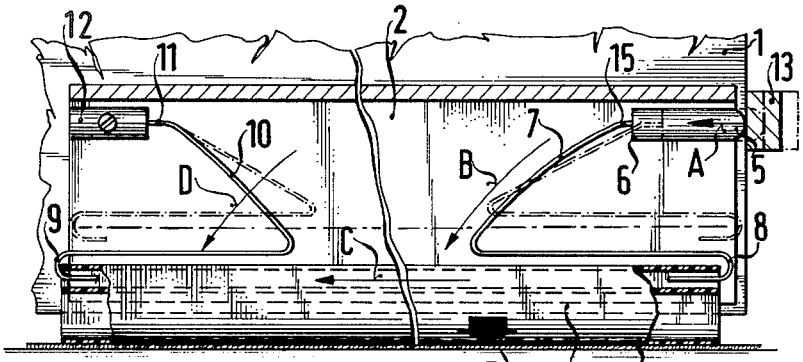
FIG. 3
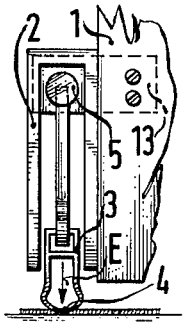
FIG. 4
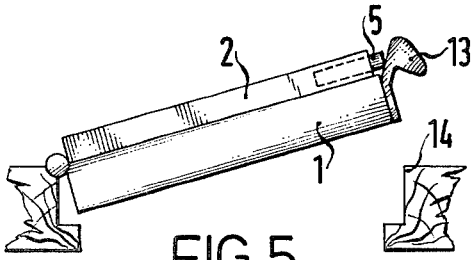
FIG. 5
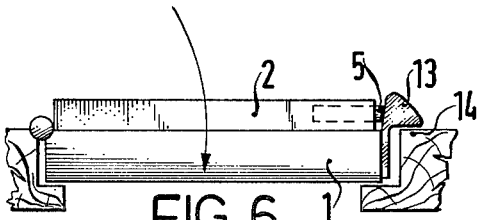
FIG. 6
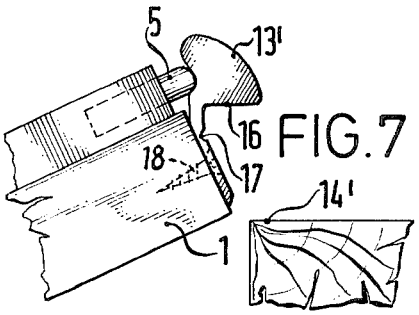
FIG. 7
FIG. 8
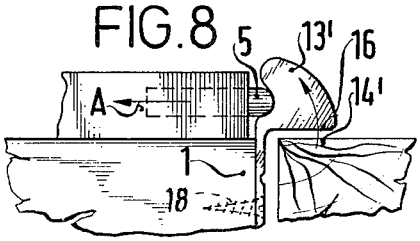

MECHANICALLY CONTROLLED SEALING RAIL FOR DOOR LEAF

The invention relates to a sealing rail for a door leaf, characterized by an especially reliable mechanical control.

BACKGROUND OF THE INVENTION

It is known that carpets frequently prevent unhindered opening of a door leaf and that the doors must be rendered freely movable again by sawing off part of the lower edge of the door leaf. Also in case of through doors without a doorsill, it is unavoidable that wide gaps remain between the lower edge of the door leaf and the floor, allowing draft air and cold to enter the room.

The invention is based on the object of overcoming this deficiency by means of a sealing rail which, upon closing of the door leaf, is mechanically controlled in an especially reliable way and seals off the undesired free gap between the floor and the door.

SUMMARY OF THE INVENTION

This object has been attained according to the invention by providing two substantially V-shaped springs with their V-shaped bend or bight portions pointing toward each other, that is, toward the interior of the door. The outer ends of the lower arms of these springs are bent in a hook-shaped fashion and hung into a longitudinal bore close to the inner longitudinal side of the sealing rail, which rail extends across the width of the bottom of the door. As for the ends of the upper arms of the springs, the end of the upper arm of one of the springs is rigidly attached to the door leaf while the end of the upper arm of the other spring is longitudinally displaceable in a direction parallel to the sealing rail and is urged inwardly from the door frame by a pivotable angle lever connected to the edge of the door leaf. As the angle lever contacts the door frame as the door is closed, it displaces one of the springs inwardly, and the two springs function to move the sealing rail downwardly into sealing engagement with the floor beneath the door.

BRIEF DESCRIPTION OF THE DRAWINGS

The drawing illustrates an example of a mechanically controlled sealing rail according to this invention for a door leaf, in which:

FIG. 1 is a foreshortened elevational view of the lower end of a door leaf with the mechanical control for the sealing rail shown in vertical section taken along the line I—I of FIG. 2;

FIG. 2 is an end elevational view as seen from the vertical, free edge of the door, with parts in phantom;

FIGS. 3 and 4 are views corresponding to an which illustrate the movements of the parts shown in FIGS. 1 and 2 during closing of the door leaf;

FIGS. 5 and 6 are schematic top plan views which illustrate a door with the mechanical control feature according to this invention when the door leaf is open and when the door leaf is closed, respectively, with the door frame shown in horizontal cross section; and FIGS. 7 and 8 illustrate another embodiment of part of the control feature of the invention, respectively in the door open and door closed positions.

DESCRIPTION OF THE PREFERRED EMBODIMENTS

A housing 2 in the form of a downwardly open, U-shaped blind fitting is attached to the lower end of a door leaf 1 and contains a floating sealing rail 3 therein with a soft sealing strip 4 along the lower edge thereof adjacent the opening of the housing and at a distance above the floor.

A pin 5 is guiding connected at one end of the blind fitting and protrudes from the end of the housing 2 and somewhat beyond the side edge of the door leaf. The inner end 6 of this pin is connected to the free end 15 of the upper arm of a spring 7 bent in a V-shape. The other end 8 of the spring 7, that is, the end of its lower arm, is bent into a hook shape, and the free end of hook 8 is connected into a longitudinal bore L on rail 3 that is positioned close to the upper or inner longitudinal side of the rail 3.

A second spring 10 having a shape similar to that of spring 7 has the free end 11 of its upper arm firmly retained in mounting element 12 in the housing 2, and the other end 9 of the lower arm of this spring is likewise formed into a hook shape and the free end of hook 9 extends into the other end of the longitudinal bore L.

An angled lever member 13, 13', is mounted to the free edge of the door leaf 1, and includes a normally outwardly biased angled pivoted lever portion that is in contact with the free end of pin 5. During the closing operation of the door, the angled pivoted lever portion of member 13 contacts the door frame 14 and is pivoted toward the free edge of the door urging pin 5 inwardly in the direction of arrow A, and thus the upper leg of the V-shaped spring 7 is moved in a downward counterclockwise arc in the direction of arrow B. During this step, the sealing rail 3 simultaneously moves downwardly in the direction of arrow E and toward the spring 10 in the direction of arrow C; thereby, the spring 10 is forced to move in a downward arc in the direction of arrow D, and thus also to urge the end of the sealing rail 3 which is on the left-hand side in the drawings in the downward direction. By this movement the soft sealing strip 4 along the lower edge of rail 3 is urged into slightly deforming contact with the floor, as shown in FIG. 4, to seal the gap between the bottom of the door leaf and the floor and thus providing an efficient weather seal against entry of air drafts beneath the door.

According to FIGS. 5–8, the angled lever member 13, 13', respectively, is preferably a unitary member constructed of a resilient material such as plastics material, with the angled pivoted lever portion or free end portion that is pivoted by contact with the door frame 14 being joined to the body portion that is firmly connected by screws 18, or the like, to the edge of the door, by means of a plastic hinge portion shown more particularly in FIGS. 7 and 8 as a weakened bending groove 17. Also shown in FIGS. 7 and 8, the pivoted lever portion 13' may have a depression therein at its point of engagement with the pin 5. The head portion of the pivoted lever portion 13' is provided with an angled surface 16 adapted to engage the outer surface 14, 14' of the door frame to pivot the lever portion counterclockwise in the direction of the arrow in FIG. 8, during the door closing operation, to move the pivoted lever portion into substantially the same plane as its stationary body portion which is connected to the door edge, while urging pin 5 inwardly in the direction of arrow A.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

I claim:

1. A mechanically controlled sealing rail for a door leaf, comprising a pair of spring members (7, 10) having bight portions pointing toward the interior of the door, a sealing rail (3) adapted to extend across the bottom of a door leaf and having longitudinal bores (L) at least in opposite ends close to the upper side of the sealing rail (3), said spring members having hook shaped (8, 9) lower ends hung into said longitudinal bores (L) at opposite ends of said sealing rail (3), one of said spring members (10) having an upper free end (11) adapted to be attached to the door leaf (1), the other of said spring members (7) having an upper free end (15) being longitudinally displaceable in parallel relation to said sealing rail, and a pivotable angle lever (13, 13') adapted to be connected at the edge of the door leaf adjacent said longitudinally displaceable upper free end (15) and connected to urge the same inwardly from the edge of the door leaf and move said sealing rail downwardly.

2. A mechanically controlled sealing rail for a door leaf as set forth in claim 1, in which said spring members are V-shaped spring members.

3. A mechanically controlled sealing rail for a door leaf as set forth in claim 1, including a downwardly opening housing, and said sealing rail and pair of spring members connected in said housing, with said sealing rail positioned adjacent the downward opening of said housing.

4. A mechanically controlled sealing rail for a door leaf as set forth in claim 3, in which said upper free end (11) of said one of said spring members (10) is connected to said housing, and said housing adapted for connection to a door leaf (1) adjacent and across the bottom edge thereof.

5. A mechanically controlled sealing rail for a door leaf as set forth in claim 3, in which said upper free end (15) of the other of said spring members (7) is displaceably guided in said housing.

6. A mechanically controlled sealing rail for a door leaf as set forth in claim 5, including a pin element (5) connected to said upper free end (15) of the other of said spring members (7) and guidingly connected to said housing and protruding from an end of said housing into contact with said pivotable angle lever.

7. A mechanically controlled sealing rail for a door leaf as set forth in claim 1, in which said pivotable angle lever has a portion resiliently biased outwardly from the edge of a door leaf into the path of the doorframe.

8. A mechanically controlled sealing rail for a door leaf as set forth in claim 7, and the longitudinally displaceable upper free end 15 when urged inwardly from the edge of the door connected to move said other of said spring members (7) in a inward and downwardly directed arc which moves said sealing rail simultaneously laterally inwardly from the edge of the door leaf and downwardly.

9. A mechanically controlled sealing rail for a door leaf as set forth in claim 8, and said one of said spring members (10) connected to be simultaneously moved by said sealing rail in a downward and laterally inward arc relative to the edge of the door leaf to which said pivotable angle lever is connected.

* * * * *